US007025032B2

(12) United States Patent
Barber et al.

(10) Patent No.: US 7,025,032 B2
(45) Date of Patent: Apr. 11, 2006

(54) PRIORITY OIL SYSTEM

(75) Inventors: Eva Barber, Novi, MI (US); Chip Hartinger, Farmington Hills, MI (US); John Edmund Brune, Stockbridge, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 206 days.

(21) Appl. No.: 10/464,197

(22) Filed: Jun. 19, 2003

(65) Prior Publication Data

US 2004/0255894 A1 Dec. 23, 2004

(51) Int. Cl.
*F01M 1/00* (2006.01)

(52) U.S. Cl. ..... 123/196 R

(58) Field of Classification Search ..... 123/196 R, 123/196 M, 90.17, 10.31; 464/2; 74/568 R
See application file for complete search history.

(56) References Cited

U.S. PATENT DOCUMENTS 5,042,445 A 8/1991 Peters et al.
5,172,661 A * 12/1992 Brune et al. ..... 123/90.17
5,184,578 A * 2/1993 Quinn et al. ..... 123/90.17
5,289,805 A * 3/1994 Quinn et al. ..... 123/90.17
5,291,860 A * 3/1994 Quinn, Jr. ..... 123/90.17
5,509,383 A 4/1996 Kahrs et al.
5,615,648 A 4/1997 Ruoff et al.
6,293,244 B1 * 9/2001 Mullins et al. ..... 123/196 R
6,295,964 B1 * 10/2001 DiMaria et al. ..... 123/196 R
6,332,444 B1 * 12/2001 Narita et al. ..... 123/196 R
6,382,155 B1 * 5/2002 Simpson ..... 123/90.17

* cited by examiner

*Primary Examiner*—Henry C. Yuen
*Assistant Examiner*—Jason Benton
(74) *Attorney, Agent, or Firm*—Diana D. Brehob

(57) ABSTRACT

The present invention comprises an oil system for supplying and controlling oil flow in an internal combustion engine having a variable camshaft timing (VCT) device, comprising a pressurized oil supply providing lubricating oil to the engine and the variable cam timing device and an oil circuit connecting the oil pump with the VCT and a main oil gallery of the engine via a valve apparatus. The valve apparatus responds to oil pressure near the outlet of the oil pump so that oil flows to the main oil gallery when oil pressure is above a predetermined pressure. When the VCT requests oil flow, oil pressure in the system drops. If the pressure drops below the predetermined pressure, the valve apparatus causes a reduction in flow to the main gallery.

20 Claims, 4 Drawing Sheets

PRIORITY OIL SYSTEM

FIELD OF INVENTION

The present invention relates, generally, to variable camshaft timing systems used on internal combustion engines and, more particularly, to the oil supply to actuate such systems.

BACKGROUND OF INVENTION

It is known in the art to employ variable camshaft timing (VCT) devices in internal combustion engines for improved fuel economy, emissions, and performance. VCT devices operate to vary the relative phasing timing between a camshaft and a crankshaft to optimize the cam timing over the range of engine operation to obtain the improvements listed above. A common method for actuating a VCT device is by routing engine oil to the VCT device. Activating the VCT device at an acceptable rate requires a significant oil flow. One solution is to use a larger oil pump on a VCT equipped engine than is used on an engine without a VCT device. However, such larger pumps add weight to the overall system and increase the power consumed by the pump, thereby reducing the performance and fuel economy gains achieved by a VCT system.

SUMMARY OF INVENTION

The inventors of the present invention have recognized that by largely diverting the flow from the engine's main oil gallery to the VCT device, during the short period for making a phasing adjustment of the VCT device, that the flow of a standard-sized oil pump is sufficient and engine components are not harmed by the brief period of significantly less oil flow.

This is accomplished by an oil system for controlling oil flow in an internal combustion engine having a variable camshaft timing device. The system has an oil pump for supplying pressurized lubricating oil to the engine and the variable cam timing device and an oil circuit connecting the oil pump with the variable camshaft timing device and a main oil gallery of the engine via a valve. The valve responds to oil pressure near the outlet of the oil pump such that the valve allows oil to flow to the main oil gallery when oil pressure is above a predetermined pressure and substantially shuts off oil flow through the valve to the main gallery when oil pressure is below the predetermined pressure.

The inventors have also recognized a method for supplying oil to a main oil gallery of an internal combustion engine and a variable camshaft timing device coupled to a camshaft of the engine by providing an oil pump coupled to the engine, piping to conduct oil between the oil pump and the variable camshaft timing device and between the oil pump and the main oil gallery, and a valve in the oil piping between the oil pump and the main gallery. Flow through the valve to the main gallery is reduced when a pressure on the oil pump side of said valve is less than a predetermined pressure.

Additionally, a solenoid valve is provided in the oil piping between the oil pump and the variable camshaft timing device. The solenoid valve is commanded to open when a demand for a variable camshaft timing device adjustment is determined, thereby allowing oil flow to the variable camshaft timing device and dropping the pressure on the oil pump side of the valve to less than the predetermined pressure.

Other advantages of the present invention will become apparent upon reading and understanding the present specification when taken in conjunction with the appended drawings.

BRIEF DESCRIPTION OF DRAWINGS

The invention will be more readily understood from a reading of the following specifications and by reference to the accompanying drawings forming a part thereof, wherein an example of the invention is shown and wherein.

Figures 1A, 1D:
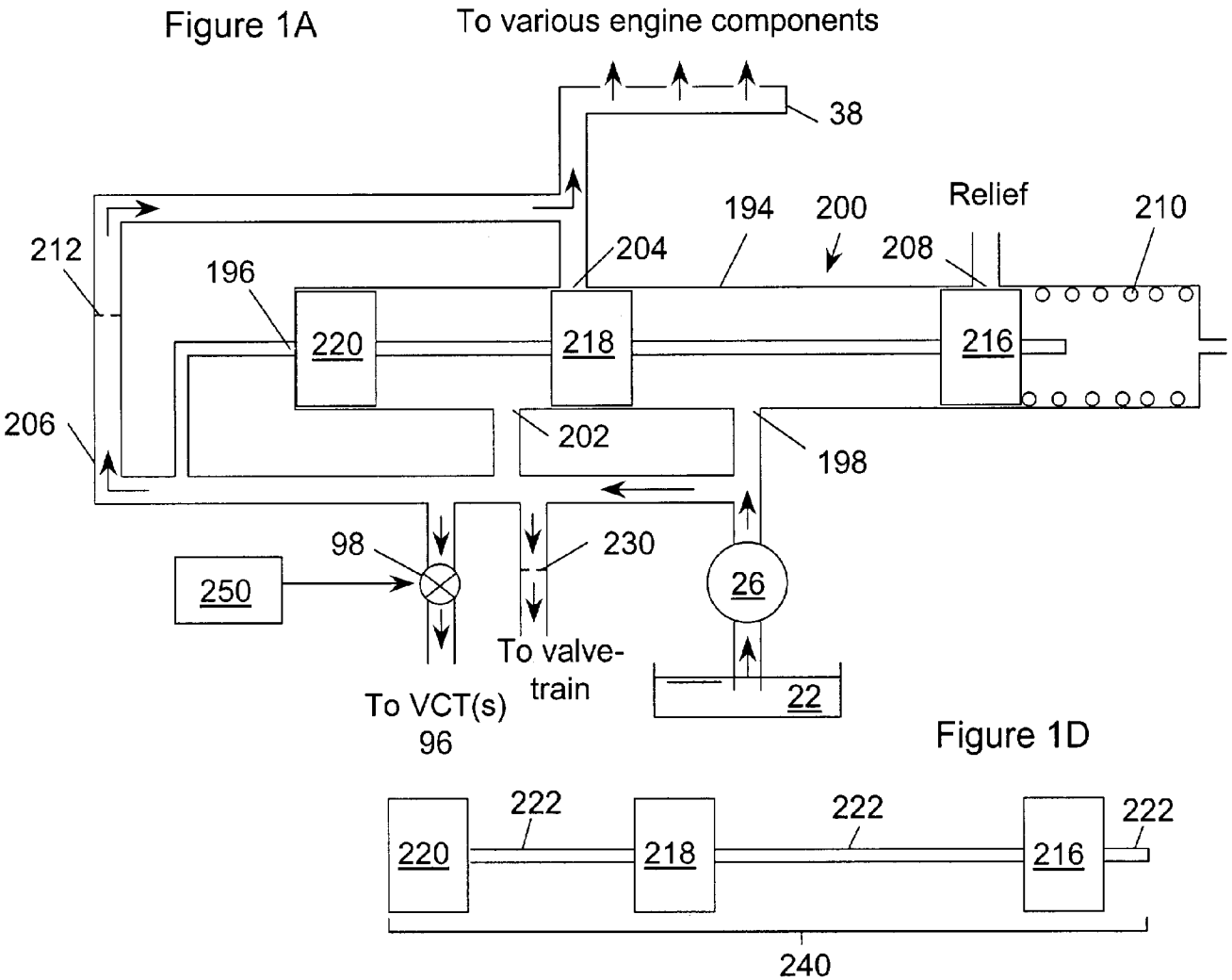
FIG. 1A is a schematic drawing of the oil priority circuit when oil pressure is at a low pressure.
FIG. 1D is a schematic of the valve of the oil priority circuit.

The construction designed to carry out the invention will hereinafter be described, together with other features thereof.

DETAILED DESCRIPTION

Referring now to the drawings in which like numerals represent similar elements or steps throughout the several views, a priority oil system for controlling flow of lubricating oil is discussed.

Before describing the operation of the priority oil circuit, the hardware is discussed, with reference to FIGS. 1A, 1B, 1C, and 1D. Oil pump 26 draws lubricating oil from oil sump 22. Oil pump 26 is shown by way of example. Any pressurized supply of oil can be substituted for oil pump 26. The oil pump supplies oil to the oil circuit shown: port 198 of valve apparatus 200, port 202 of valve apparatus 200, port 196 of valve apparatus 200, to the valvetrain via orifice 230, to solenoid valve 96 connected to VCT 96, to main gallery 38 via bypass orifice 212. Main gallery 38 connects to various engine components including bearings and internal piping to provide oil to the engine. Valve apparatus 200, which controls the flow of oil in the priority oil circuit, has a valve body 194 within which valve 240 translates. Valve 240 is not explicitly called out by numeral in FIG. 1A, but is shown with its component parts in FIG. 1D: relief land 216, main land 218, and control land 220 and shaft 222. Note that lands 218 and 220 have oil pressure acting on both sides of the lands; thus, no net force is generated on these lands. Valve apparatus 200 has inlet ports 198 and 202 and outlet ports 204 and 208. Port 196 of valve apparatus 200 allows oil pressure to act on the left hand side of control land 220 and to allow oil to flow in and out of the volume within valve body 194 as needed when valve 240 moves back and forth.

The operation of the priority oil circuit is now described with reference to FIGS. 1A, 1B, and 1C. FIG. 1A illustrates a situation in which VCT 96 has been commanded to adjust position, i.e., adjust toward a more retarded or more advanced condition. The demand for a VCT actuation is determined in engine controller 250. To allow oil from oil pump 26 to flow to VCT 96, solenoid valve 98 is opened, as commanded by controller 250. Flow is caused to flow to one side of VCT 96 to effect valve timing retardation and to the other side of VCT 96 to effect valve timing advancement. Such detail in not represented in the figures. Because of oil being diverted to VCT 96, pressure in the lines upstream of oil pump 26 is lower than when solenoid valve 98 is closed. This lower pressure is acting on the left hand side of land 220. Spring tension 210 overcomes the force caused by the pressure on land 220 thus causing valve 240 to translate to the left within valve body 194. Main land 218 occludes port 204 preventing flow to travel through port 202 to main gallery 38. Some oil flows to main gallery 38 via bypass orifice 212 under all conditions. However, the majority of the oil flows to VCT 96. When VCT 96 has adjusted to the desired position, flow through solenoid valve 98 is closed by controller 250, flow through VCT valve 96 ceases and oil pressure in the circuitry upstream of oil pump 26 increases.

Figure 1B:
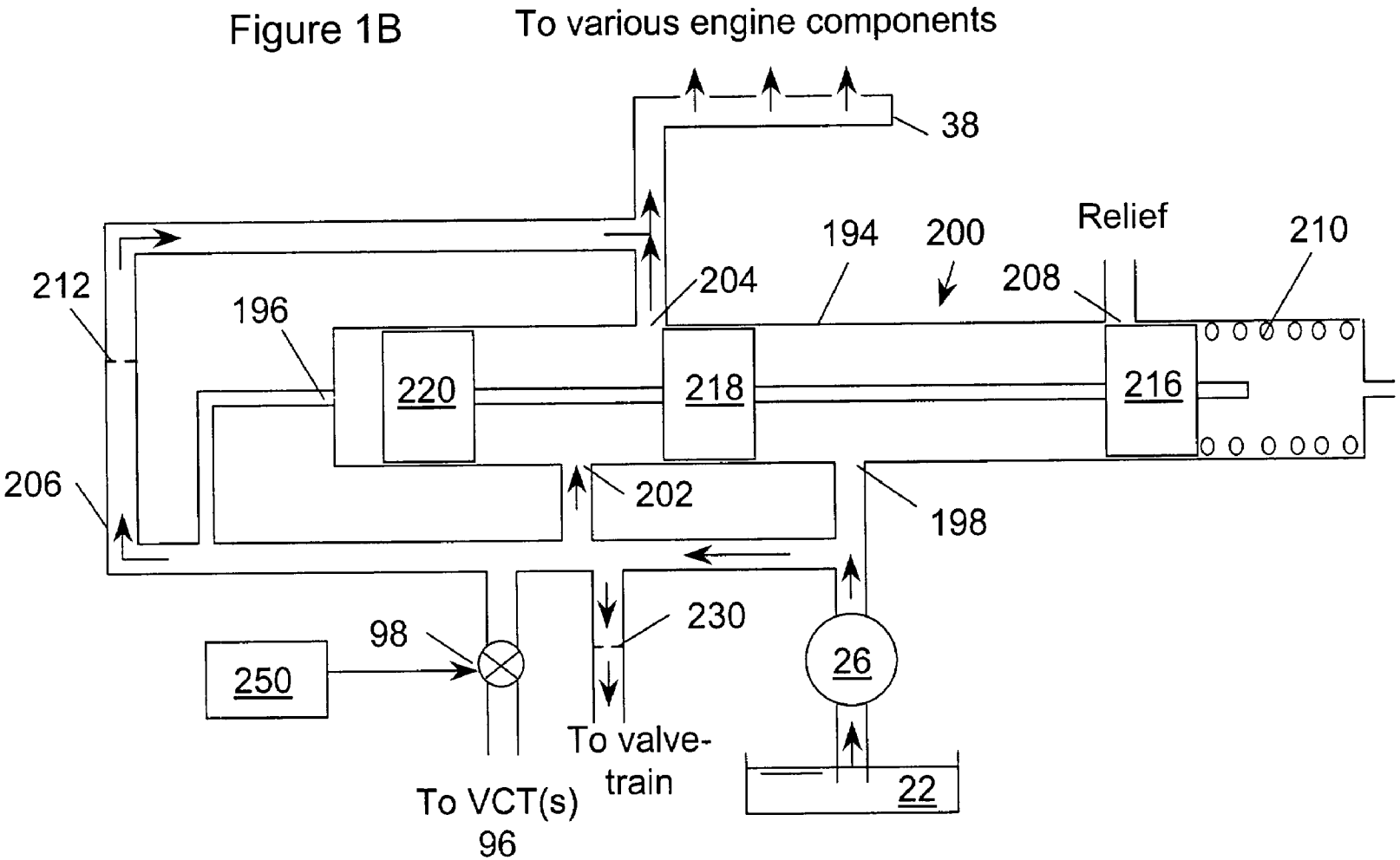
FIG. 1B is a schematic drawing of the oil priority circuit when oil pressure is at a normal operating pressure.

Referring now to FIG. 1B, the situation in which little or no flow is being diverted to the VCT is shown. In this case, as mentioned above, oil pressure in the circuitry rises to normal operating pressure. This higher pressure acts on the left hand side of land 220 and compresses spring 210 and allows valve 240 (including elements 216, 218, and 220), to translate to the left. In this position, port 204 is open and oil flows through valve apparatus 200 to feed main gallery 38. Flow continues to flow through bypass orifice 212 to also feed main gallery 38.

Figure 1C:
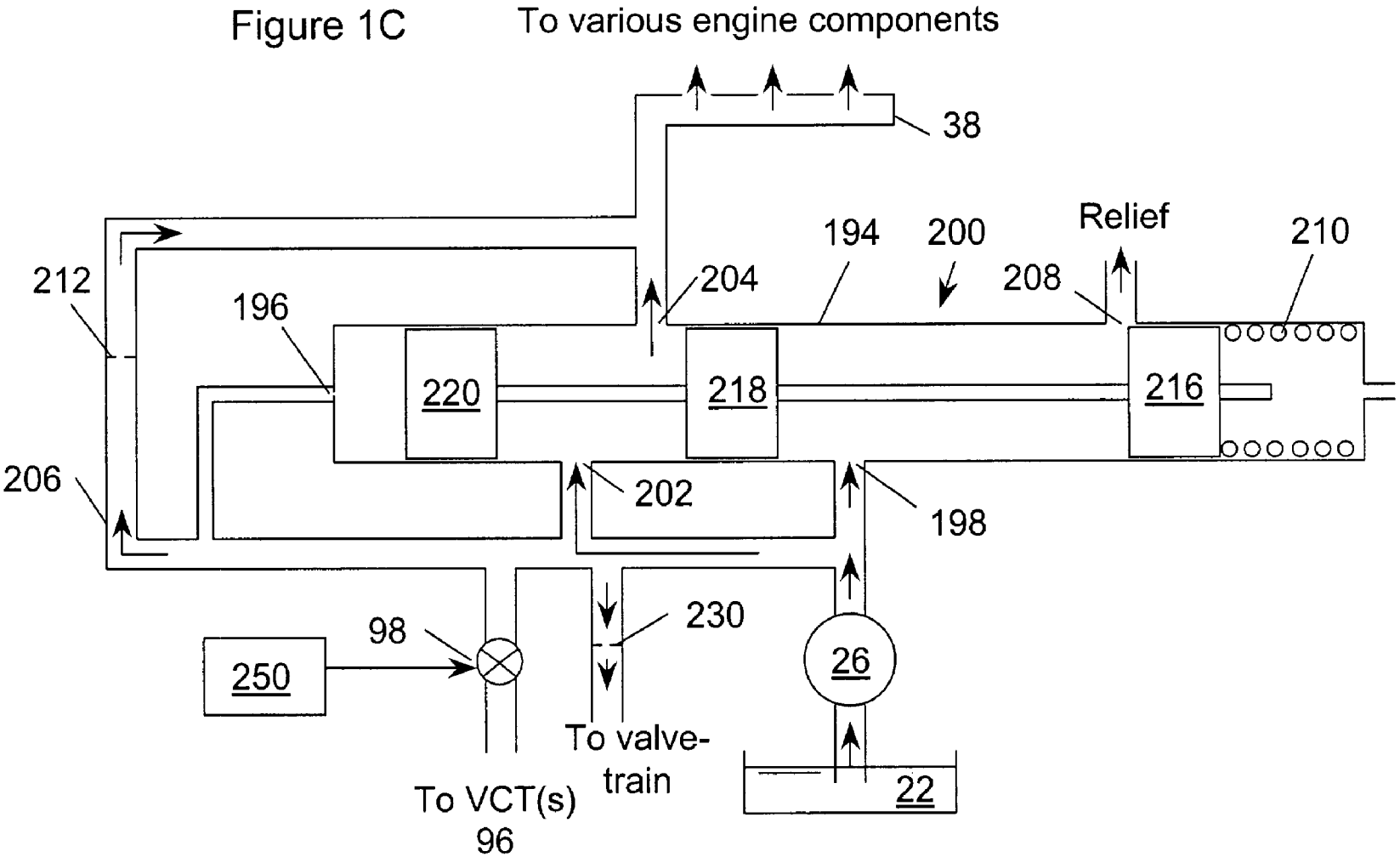
FIG. 1C is a schematic drawing of the oil priority circuit when oil pressure is above maximum design system pressure.

In FIG. 1C, a situation in which oil pressure has exceeded the maximum desired system pressure, is shown. Oil pump 26 is typically driven by the engine and thus rotates in proportion to engine speed. At high engine speed, the pump delivers more oil than is needed, thereby causing the pressure to rise. To avoid oil seeping through gaskets or other unintentional seepage, it is desirable to relieve the pressure so that it cannot exceed maximum desired system pressure. Due to the high pressure in the system, the force acting upon relief land 220 is high and compresses spring 210 such that valve 240 translates to the right. In the position shown in FIG. 2C, relief land 216 uncovers port 208 and allows flow through the relief circuitry. Fluid continues to flow to the valvetrain through orifice 230, to the main gallery 38 through orifice 212, and to the main gallery 38 through valve apparatus 200 via ports 202 and 204.

The system shown in FIGS. 1A, 1B, and 1C shows plunger 240 having three lands 216, 218, and 220. In an alternate embodiment, the pressure relief function is not included in valve apparatus 200. In this alternative, relief land 216, inlet port 198, and relief port 208 are not part of valve apparatus 200.

Figure 2:
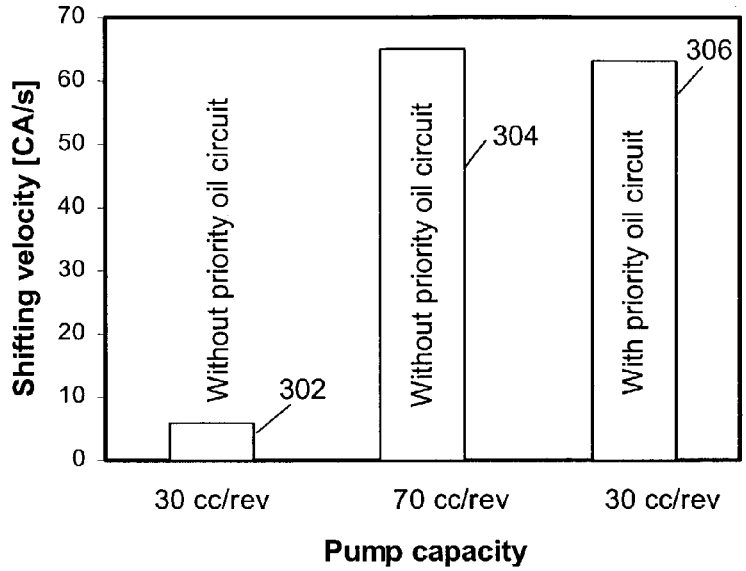
FIG. 2 is a graphical representation of an exhaust retard shifting speed comparison of engine performance according to the present invention.
Figure 3:
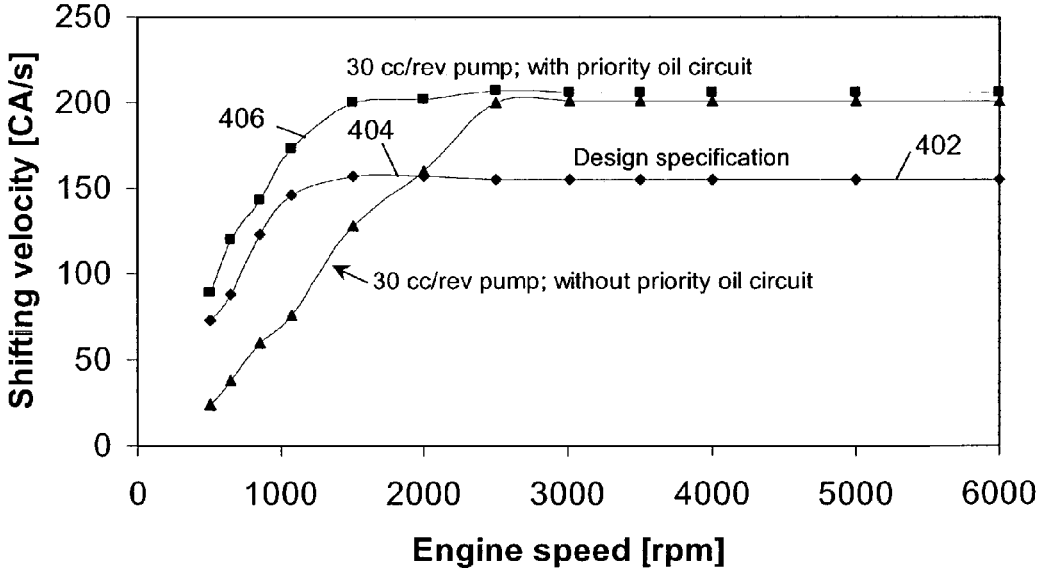
FIG. 3 is a graphical representation of an intake retard shifting speed comparison of engine performance according to the present invention.

FIGS. 2 and 3 are graphical representations of test results from the implementation of the invention as described in FIG. 1B.

FIG. 2 is a graphical representation of an exhaust retard shifting speed comparison of a VCT equipped engine at 500 rpm and 250° F. oil temperature operating conditions. FIG. 2 shows the shifting speed, measured in crankshaft angle degrees per second [CA/s], for a VCT with and without the present invention. Bar 302 illustrates that a 30 cubic centimeters per revolution (cc/rev) oil pump is able to shift the VCT at a shifting speed of 6 CA/s. When the priority circuit is added to the same engine with the same 30 cc/rev displacement pump, the shifting speed increases to 63 CA/s, as shown in bar 304. By comparison, bar 306 illustrates that the VCT equipped engine without the priority circuit requires an oil pump with a 70 cc/rev displacement to meet or exceed the camshaft shifting performance of the engine equipped with the priority circuit.

FIG. 3 graphically represents intake retard shift speed as a function of engine rotational speed. Curve 402 shows the design specification or target values for a minimum acceptable shifting speed. Shift speeds lower than the target values result in losses in performance, potentially higher emissions during the delay and more difficulty in controlling the engine during the transition. Curve 404 shows the VCT shift performance over the speed range of the engine. As shown, the shift speed is below the design specification shift speed until the engine reaches 2000 rpm, i.e., when oil pump speed is high enough to provide sufficient oil capacity for all engine components, as well as the VCT. As mentioned above, a prior solution is to increase the size of the oil pump with the concomitant fuel efficiency penalty. Curve 406 shows the priority oil circuit of the present invention using the same 30 cc/rev oil pump as used with curve 404. The VCT shift speed is more than adequate over the entire engine speed range, i.e., it exceeds the design specification at all engine speeds.

The present invention has been described in relation to particular embodiments, which are intended in all respects to be illustrative rather than restrictive. Alternate embodiments will become apparent to those skilled in the art to which the present invention pertains without departing from its spirit and scope. Accordingly, the scope of the present invention is described by the appended claims and supported by the foregoing description.

We claim:

1. An oil system for supplying and controlling oil flow in an internal combustion engine having a camshaft timing device, comprising:

an oil pump for supplying pressurized lubricating oil to the engine and the variable cam timing device:

an oil circuit connecting said oil pump with the variable camshaft timing device and a main oil gallery of the engine via a valve apparatus, said valve apparatus responding to oil pressure near the outlet of said oil pump wherein said valve apparatus causes oil to flow to said main oil gallery when oil pressure is above a predetermined pressure and substantially shuts off oil flow through said valve apparatus to said main gallery when oil pressure is below said predetermined pressure a solenoid valve in an oil passage between said oil pump and the variable camshaft timing device; and a controller operably connected to the engine and the solenoid valve, said controller allowing oil to flow to said variable camshaft timing device when an adjustment of the variable camshaft timing device is desired.

2. The system of claim 1 wherein said controller determines said desire to adjust the variable camshaft timing device and said controller commands said solenoid valve to open in response to said desire to adjust the variable camshaft timing device.

3. The system of claim 1 wherein pressure in said oil circuit near the outlet of said pump drops in response to oil flow to the variable cam timing device thereby causing a reduction in said oil flow through said valve apparatus to said main gallery.

4. The system of claim 1 wherein said controller causes said solenoid valve to close when a desired camshaft timing has been achieved, said closed solenoid valve causing pressure at an outlet of said oil pump to rise thereby causing said valve apparatus to allow flow to said main oil gallery.

5. The system of claim 1 wherein said valve apparatus includes a spring, a member, an inlet port coupled to an output side of the oil pump, and an outlet port coupled to said main oil gallery, said member being acted upon in a first direction by said spring and in a second direction opposite to said first direction by oil pressure, said member covering said outlet port when oil pressure at an outlet of the pump is less than said predetermined pressure.

6. The system of claim 5 wherein said member comprises a valve land translating inside a valve body of said valve apparatus, an interior of said valve body having a roughly cylindrical bore and said inlet and outlet ports being through said cylindrical bore of said valve body.

7. The system of claim 5 wherein said valve apparatus is a linear spool and said member translates through said valve apparatus.

8. A method for supplying oil to a main oil gallery of an internal combustion engine and a variable camshaft timing device coupled to a camshaft of the engine, comprising:

providing an oil pump coupled to the engine;

providing piping to conduct oil between said oil pump and the variable camshaft timing device and between said oil pump and the main oil gallery; and providing a valve apparatus in said oil piping between said oil pump and the main gallery, wherein flow through said valve apparatus to the main oil gallery is stopped when a pressure on the oil pump side of said valve apparatus is less than a predetermined pressure.

9. The method of claim 8, further comprising:

providing a solenoid valve in said oil piping between said oil pump and the variable camshaft timing device; and commanding said solenoid valve to open when a demand for a variable camshaft timing device adjustment is determined, thereby allowing oil flow to the variable camshaft timing device and dropping said pressure on the oil pump side of the valve to less than said predetermined pressure.

10. The method of claim 9, further comprising:

commanding said solenoid to close when said variable camshaft timing device is determined to be at a desired phase thereby stopping oil flow to the variable camshaft timing device and causing pressure to rise on the oil pump side of the valve.

11. The method of claim 8 wherein said valve apparatus comprises a cylindrical valve body having first and second ends and a spring and valve disposed within said valve body, said spring acting upon said valve to bias the valve in a first direction, said cylindrical valve body has an inlet port coupled to said oil pump and an outlet port coupled to said main oil gallery, said valve having lands attached thereon which occlude at least one of said oil inlet and said oil outlet when pressure acting on said valve in a second direction opposite to said first direction is less than a predetermined pressure.

12. A valve apparatus for directing oil flow though oil circuitry in an internal combustion engine having an oil actuated variable camshaft timing device, comprising:

an inlet port coupled to an oil pump;

an outlet port coupled to a main oil gallery in the engine;

a spring disposed within said valve apparatus; and a member disposed within the valve apparatus upon which outlet pressure of said oil pump acts in a first direction and a spring force of said spring acts in an opposite direction to said first direction wherein said member assumes a first position when said pressure is less than a predetermined pressure and said member assumes a second position when said pressure is greater than a predetermined pressure, said first position is such that said member occludes at least one of said outlet ports.

13. The valve apparatus of claim 12 wherein said second position of said member allows oil to flow through the valve apparatus from said inlet port to said outlet port to supply oil to said main oil gallery.

14. The valve apparatus of claim 12 wherein an interior surface of a body of the valve apparatus is cylindrical with a first end away from said spring and a second end near to said spring and said valve apparatus has a valve disposed therein, said having a central shaft and a land attached thereto, said land being said member which is capable of occluding at least one of said outlet ports.

15. The valve apparatus of claim 12, further comprising:

a control land attached to said valve; and an oil pressure port though said first end of said valve body, said oil pressure port being coupled to an outlet of said oil pump.

16. The valve apparatus of claim 12 wherein the variable camshaft timing device is coupled to the oil circuitry via a solenoid valve, said solenoid valve being actuated to permit oil flow to the variable camshaft timing device in response to a demand for a change in camshaft timing.

17. The valve apparatus of claim 16 wherein oil flow to the variable camshaft device causes outlet pressure of said oil pump to become less than said predetermined pressure.

18. The valve apparatus of claim 12, further comprising:

a relief inlet port coupled to said oil pump;

a relief outlet port coupled to a pressure relief circuit, a relief member disposed within the valve apparatus wherein said relief member occludes said relief outlet port when said outlet pressure of said oil pump is less than a maximum design pressure and said relief member allows flow through the valve apparatus through said relief inlet port and said relief outlet port when said outlet pressure of said oil pump is greater than a maximum design pressure.

19. The valve apparatus of claim 18 wherein said maximum design pressure is in the range of 450 and 550 kPa gauge pressure.

20. The valve apparatus of claim 18 wherein an interior surface of a body of the valve apparatus is cylindrical and inside said valve body is a valve onto which are attached said member and said relief member, said member and said relief members being cylindrical lands.

* * * * *